United States Patent [19]

Tucker

[11] Patent Number: 4,787,564

[45] Date of Patent: Nov. 29, 1988

[54] ROCK-CRUSHER SHOE

[76] Inventor: Garry Tucker, P.O. Box 171, Tualatin, Oreg. 97062

[21] Appl. No.: 15,484

[22] Filed: Feb. 9, 1987

Related U.S. Application Data

[63] Continuation-in-part of Ser. No. 674,082, Nov. 23, 1984, abandoned.

[51] Int. Cl.[4] ..... B02C 19/00

[52] U.S. Cl. ..... 241/275

[58] Field of Search ..... 241/275, 195, 197

[56] References Cited

U.S. PATENT DOCUMENTS

| | | | |
|---|---|---|---|
| 2,637,502 | 5/1953 | Bond | 241/275 X |
| 2,874,912 | 2/1959 | Sennholtz et al. | 241/197 |
| 3,000,579 | 9/1961 | Bridgewater | 241/275 |
| 3,023,973 | 3/1962 | Conley et al. | 241/275 |
| 3,032,169 | 5/1962 | Bridgewater | 241/275 X |

FOREIGN PATENT DOCUMENTS

| | | | |
|---|---|---|---|
| 2307988 | 9/1974 | Fed. Rep. of Germany | 241/195 |

*Primary Examiner*—P. W. Echols
*Assistant Examiner*—Joseph M. Gorski
*Attorney, Agent, or Firm*—Chernoff, Vilhauer, McClung & Stenzel

[57] ABSTRACT

An impeller blade shoe for a centrifugal impact rock-crushing machine includes protrusions on the surface of the shoe that cause its wear surface to wear more evely when subjected to a stream of aggregate. The protrusions may take the form of a staggered pellet matrix or radially directed grooves or ridges.

3 Claims, 3 Drawing Sheets

FIG. 1
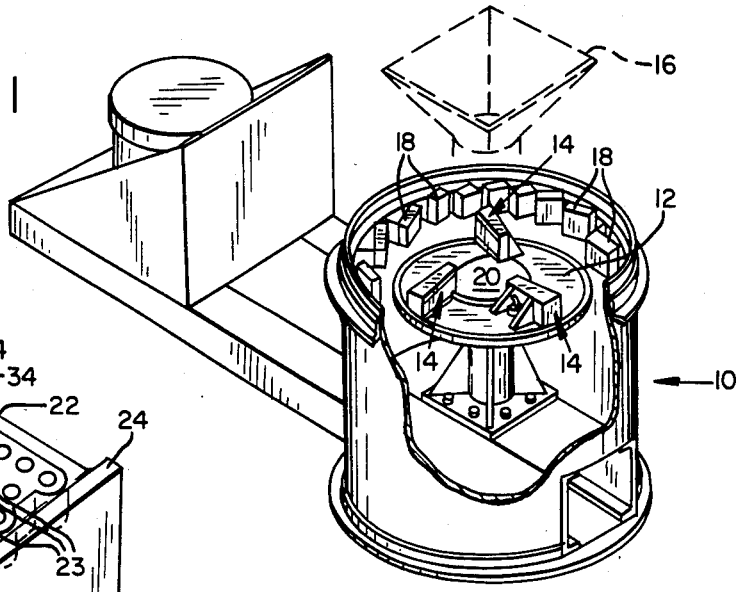
FIG. 2
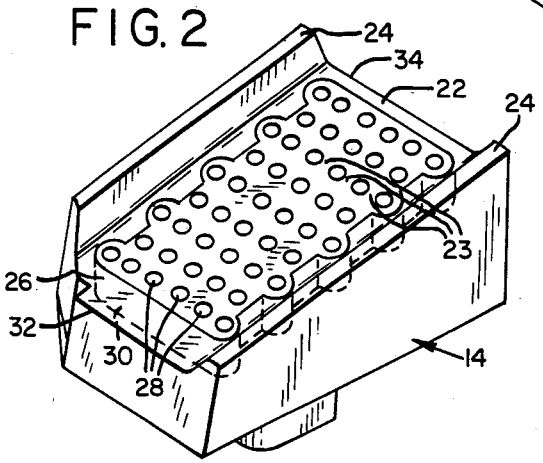
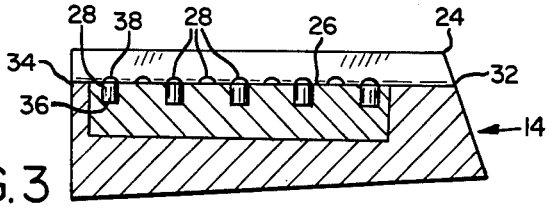
FIG. 3
FIG. 2a
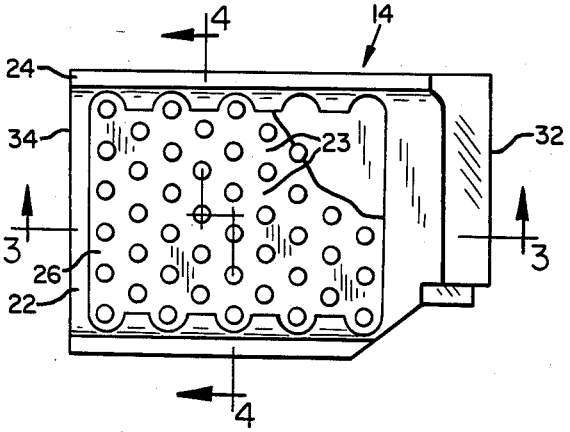
FIG. 4
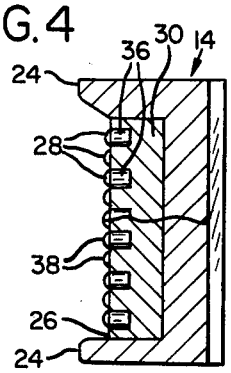
FIG. 5
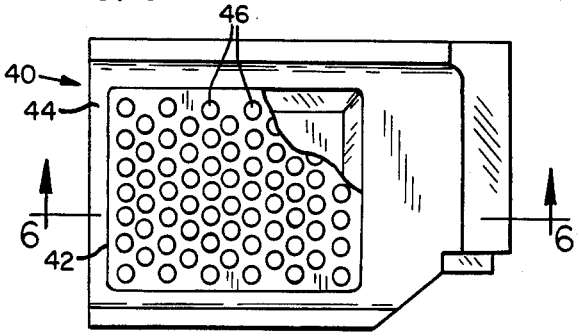
FIG. 6
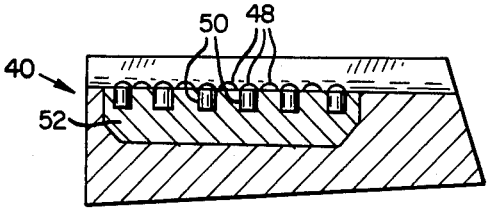

ROCK-CRUSHER SHOE

This application is a continuation-in-part of application Ser. No. 674,082, filed Nov. 23, 1984, now abandoned.

BACKGROUND OF THE INVENTION

The following invention relates to a shoe for an impeller-type rock-crushing machine.

Impact-type rock-crushing machines have a flat or gently sloping turntable upon which are mounted a plurality of impeller blades or shoes. Rock is dropped onto the center of the turntable as it is spinning and the centrifugal force of the spinning table forces the stones outwardly where they are thrown by the impeller shoes against anvils located against a cylindrical wall spaced radially outwardly of the turntable. An example of such a rock crushing device is shown in Ackers U.S. Pat. No. 4,090,673.

The continuous nature of the aggregate feed onto the turntable creates a continuous stream of particulate matter which flows across the face of each of the impeller shoes. This continuous stream flow of particulate matter tends to concentrated along a single path across the wear surface of each of the particular shoes. This results in premature wearing of the shoes because the stream flow creates a groove or channel that cuts into the surface of the shoe along a single path rather than wearing down the surface of the shoe evenly. The reason for the wearing down of the surface of the shoe in this manner is not precisely known, but apparently the particulate matter stream behaves as a fluid and thus follows any groove or undulation created in the shoe instead of striking the surface randomly. The fact that the stream of constantly-flowing particulate matter is concentrated in a surface region much narrower than the width of the shoe leads to premature wearing of the shoe and necessitates its frequent replacement.

In the past, shoes for impeller-type rock-crushing machines have been smooth-faced. An example of such a shoe is shown in Warren U.S. Pat. No. 4,174,814. The Warren patent discloses a generally trapezoidal shoe surface having a smooth-faced working surface formed of cast iron. Smooth-surfaced shoes such as the type shown in the Warren patent, however, do not provide any means for breaking up the stream flow of particulate matter which tends to concentrate along a single path and create a wear-valley. Once the wear-valley progresses through the surface of the shoe and begins to reach the base material of the shoe, that is, the support portion of the shoe, the shoe must be replaced in its entirety.

What is needed, therefore, is an impeller blade shoe having means for breaking up the concentrated stream flow of particulate matter so that the shoe wears more evenly, and hence, lasts longer since the material flow across the surface of the shoe will no longer be confined to a single location.

SUMMARY OF THE INVENTION

The present invention solves the aforementioned problem of premature wear of impeller blade shoes by providing a means in the surface of the shoe for diverting a stream of particulate matter into a plurality of component branches which fan out across the surface of the shoe, thereby causing the shoe to wear more evenly. This diverting means may comprise, for example, a matrix of tungsten carbide pellets having spherical tops which are embedded in a white iron matrix. Other examples of means for diverting the flow of the stream of particulate matter include a shoe surface having a series of ridges with an aerodynamic contour arranged to be substantially parallel to the radial direction of aggregate stream flow. In yet another embodiment of the invention, a plurality of shallow grooves in the surface of the shoe will also cause the aggregate stream to be broken up into a plurality of component paths.

Accordingly, it is primary object of this invention to provide a impeller blade shoe that will wear much longer than conventional, smooth-surfaced shoes.

It is a further object of this invention to provide an impeller blade shoe having means for diverting the flow of a stream of particulate matter across a surface of the shoe into component paths so as to cause the shoe to wear more evenly, and hence, last longer.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a partial perspective view of a centrifugal impact-type rock-crushing machine of the type employing the impeller shoes of the present invention.

FIG. 2 is a perspective view of an impeller blade shoe having a wear-surface insert formed of tungsten carbide pellets.

FIG. 2A is a top view of the impeller blade shoe shown in FIG. 2.

FIG. 3 is a cutaway view taken along line 3—3 of FIG. 2A.

FIG. 4 is partial cutaway view of the impeller blade shoe of FIG. 2A taken along line 4—4 of FIG. 2A.

FIG. 5 is a top view of a second embodiment of a rock-crusher shoe employing the tungsten carbide pellets in an insertable wear-surface.

FIG. 6 is a cutaway view taken along line 6—6 of FIG. 5.

Figure 10:
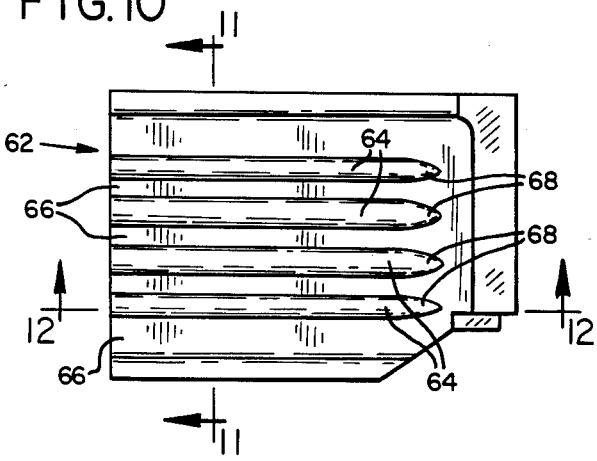
FIG. 10 is a top view of an embodiment of the invention utilizing aerodynamically-shaped ridges formed in the wear surface of the shoe.

FIG. **11*a* is a cutaway view of a rock-crusher shoe which is a modification of the embodiment of FIG. 10**.

Figure 11:
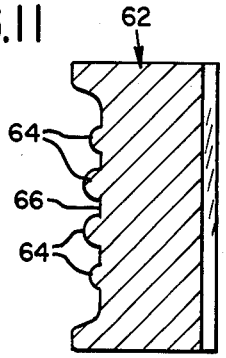
FIG. 11 is a cutaway view taken along line 11—11 of FIG. 10.
Figure 11A:
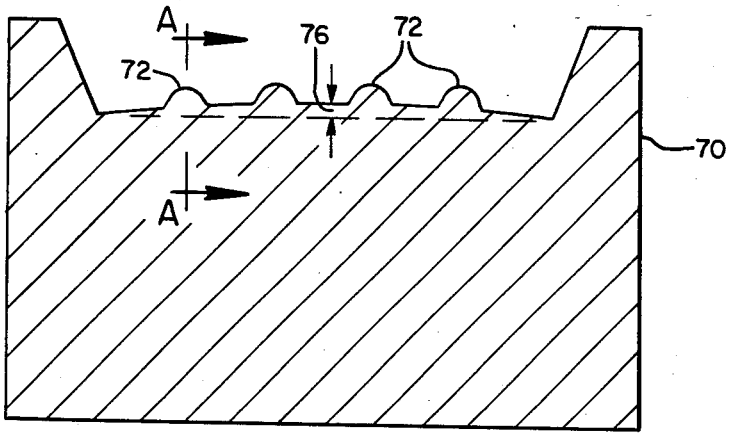

FIG. **12*a* is a cutaway view of the modified shoe of FIG. 11*a*** taken along line A—A thereof.

DETAILED DESCRIPTION OF THE INVENTION

Referring now to FIG. 1, an impact-type rock-crushing machine 10 includes a turntable 12 which revolves at a high speed about a central shaft (not shown). Impeller blade shoes 14 are affixed to the turntable 12 at regular intervals along its surface. Rock or other aggregate (not shown) drops onto the turntable from a funnel 16 located above the turntable, and the centrifugal force caused by the rotating shoes slings the rock outwards causing it to strike a series of anvils 18 and be crushed. Initially the rock or aggregate falls on a cone portion 20 of the turntable 12 but as the turntable is rotating, the rock spreads outward along the cone forming streams of material, particulate in nature, which flow across the wear surfaces of each of the impeller blade shoes 14.

A particular form of the impeller blade shoe 14 is illustrated in FIG. 2. The shoe includes a planar wear surface 22 with flanged edges 24. The edges 24 serve to channel the stream of particulate matter across the wear surface 22 of the shoe 14. Wear surface 22 includes an insertable portion 26 which includes a regular matrix of tungsten carbide pellets 28 embedded in a chrome iron or white iron matrix 30. The plate 26 is insertable into the shoe and may be affixed to the shoe 14 by epoxy cement or the like or may be affixed thereto by bolts. A separate insertable wear plate 26 is advantageous because it is easier to cast the pellets 28 into a retangular plate than into a shoe having flanged portions such as portions 24. Also, it may be desired to remove the wear plate and replace it separately when it wears through without replacing the entire shoe.

The flow of the stream of particulate matter across wear surface 22 proceeds from the inner end of the shoe 32 to the trailing edge of the shoe 34. The tungsten carbide pellets 28 serve to break up this flow since they are arranged in a regular matrix in which successive alternate rows of the pellets are staggered so as to lie within the gaps 23 created in the next preceding or succeeding row. Viewed in a direction parallel to the direction of stream flow (see FIG. 4), the gaps referred to herein are the lateral distances between each of the pellets 28 in the same row. Each pellet in a row lies within the gap between pellets in the next preceding or succeeding row. The pellets 28 have a generally cylindrical base 36 which is embedded in a chrome iron or white iron matrix 30 which forms the main body of removable plate portion 26. The pellets have semispherical or partially semispherical caps 38 so as to avoid presenting any sharp corners to the aggregate stream flow.

The matrix of tungsten carbide pellets serves to divert the flow of the stream of particulate matter into a plurality of component branches which weave among the gaps so that the wear surface 22 of the shoe 14 wears substantially more evenly. In this way the stream flow is not concentrated in any particular location across the face of the shoe. This avoids the wear-valley effect which would ultimately lead to premature wearing through of the wear portion of the shoe and necessitate its replacement. Depending upon the size of the aggregate to be used in the rock-crushing machine 10, the pellet matrix may be more widely dispersed across the surface of the shoe as shown in FIGS. 2, 2A, 3 and 4, or may be more tightly packed as shown in FIGS. 5 and 6.

In FIG. 5, a shoe 40 includes a removable wear plate 42 which comprises a portion of planar wear surface 44. Plate 42 may be affixed to shoe 40 by means of epoxy cement or the like. Plate 42 includes a matrix of tungsten carbide pellets 46 arranged in staggered rows but more densely packed than the embodiment of FIG. 2. The pellets 46 have a partially spherical cap 48 and a cylindrical base 50 which is embedded in a chrome iron matrix 52 which comprises the main body of plate 42. The more densely packed matrix of FIGS. 5 and 6 is particularly applicable for aggregate having a finer composition than the aggregate which would be used in connection with the shoes of FIGS. 2 through 4. For particulate matter having larger dimensions such as, for example, four-inch rock, the the pellet matrix should be more widely spread out over the surface of the shoe. With finer particulate matter however, a widely staggered pellet matrix could allow wear channels to develop and, hence, the denser matrix of FIGS. 5 and 6 is recommended.

Figure 7:
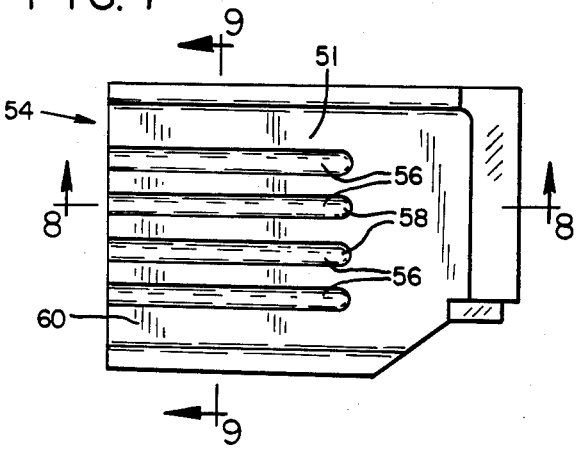
FIG. 7 is a top view of an embodiment of the invention employing semi circular grooves cut into the wear surface of the shoe.
Figure 8:
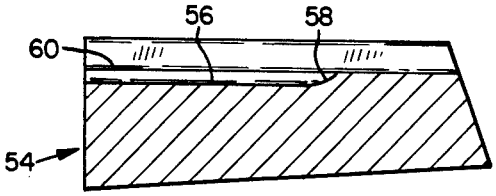
FIG. 8 is a cutaway view taken along line 8—8 of FIG. 7.
Figure 9:
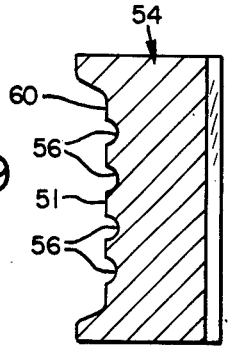
FIG. 9 is a cutaway view taken along line 9—9 of FIG. 7.

Another embodiment of the invention is shown in FIGS. 7, 8 and 9. In this embodiment a plurality of grooves are formed in the planar wear surface 51 of the shoe 54 when it is cast, providing a plurality of paths for diverting the flow of the stream of particulate matter from a single location to a plurality of locations spaced across the surface of the shoe. Accordingly shoe 54 includes a plurality of grooves 56 which are arranged to lie parallel to the general direction of stream flow. The radially innermost end of each of the grooves 56 has a tapered portion 58 which aids in capturing the stream flow and channeling it through the grooves 56 so as to spread the wearing effect across the face of the shoe.

The shoe 54 may be composed of an alloy of chromium and iron consisting essentially of 27% chromium with the balance in iron and trace materials. Such a composition is well-known in the trade and is often referred to as white iron.

Figure 12:
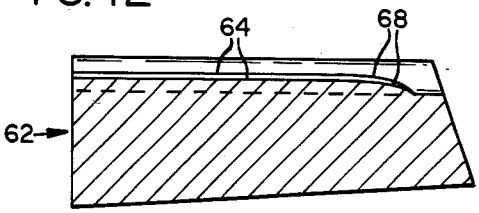
FIG. 12 is a cutaway view taken along line 12—12 of FIG. 10.

FIGS. 10, 11 and 12 show yet another embodiment of the invention utilizing aerodynamically-tapered ridges to divert the flow of a stream of particulate matter across the face of the shoe 62 into one or more component branches. According to this embodiment, a shoe 62 includes a plurality of ridges 64 formed in the planar surface 66 of the shoe 62 when it is cast. As shown in FIG. 11, the ridges 64 are semicircular in cross section and have aerodynamically-shaped tips 68 at their radially innermost ends. The tapered tips 68 serve to gradually increase the diverting effect of the ridges 64 as the stream of particulate matter moves from radially innermost to radially outmost portion of the shoe. This tends to aid in capturing the aggregate stream and in channeling the stream flow into a plurality of component branches so as to result in more even wearing of shoe surface 66.

A modified version of the shoe shown in FIG. 10 (refer to FIGS. 11*a* and 12*a*) provides better performance and reduces the wear on the anvils 18. Referring to FIG. 11*a*, the shoe 70 includes ridges 72 in the face thereof which all have the same circular cross-sectional shape. These ridges 72 are smaller than the center ridges 64 in the shoe 62 of FIG. 11.

More and smaller ribs provide better distribution of material across the face of the shoe than do, fewer, more massive ribs. This is due to the fact that wear channels tend to be created by eddy currents resulting from the vortexing of materials that are fine and thus have the characteristics of a fluid which is more reactive to air currents. These eddy currents are very thin and flow just above the surface of the shoe. Larger particles tend to follow the wear channels created by the vortexing affect, so it is important to prevent such wear channels from ever forming. Smaller ribs are much more effective for preventing this vortexing effect because such ribs lie directly in the path of the eddy currents but are slightly higher. In shoes having large ribs, vortices can form in between the ribs and wear a channel that will tend to funnel all of the aggregate towards one spot on the anvils, as well as wear out the shoe prematurely. The ribs 72 should have a radius of between 3/16" and 5/16" to function properly. If more ribs are used, for example, 5, smaller radius should be employed. There should, however, be at least three ribs with a radius not exceeding 5/16".

Figure 12A:
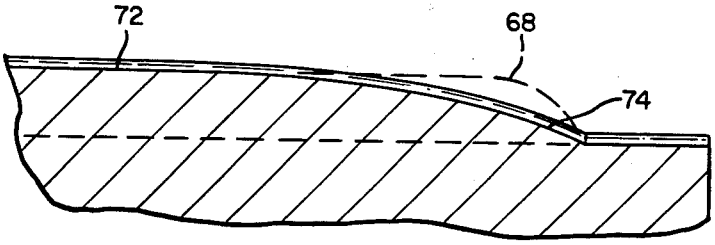

Referring to FIG. 12*a*, a ridge 72 has a tapered tip portion 74 that has a much gentler slope than tip 68 as shown in dashed outline. The sharper slope of tip 68 could cause a sharp discontinuity in air flow which in turn could create undesirable localized wear patterns.

There will still exist a tendency to wear more unevenly in the center portion of the shoe 70, so the ridges 72 are formed on a slightly crown 76 which has its peak in the center of the shoe 70. The dashed line in FIG. 11*a* represents what would have been the "level" surface of the shoe 70 without the crown 76, which is shown between the arrows. It has been discovered that the eddy currents tend to flow toward the center of the shoe. The crown 76 helps to compensate for the slight uneveness of wearing that occurs in the center so that the face of the shoe 70 as a whole will experience the same degree of wear over the life of the shoe 70 and no one area will wear out prematurely.

As with the embodiment of FIGS. 7, 8 and 9, the shoes of FIGS. 10, 11 and 12 may be formed of white iron.

Other means for diverting a stream of particulate matter across the shoe face from a single locus could be employed in addition to those which have been described above. For example, random chunks of tungsten carbide embedded in a chrome iron liner could be used. Although it is believed that a regular, as opposed to a random, pattern of diverting protrusions on the surface of the shoe results in more even wearing, any corrugations in the surface of the shoe, as long as they are more or less evenly dispersed, will aid in breaking up the wear-valley effect. Also, other means could be used to affix a removable wear plate holding the tungsten carbide pellets to the body of the shoe. For example, these could be bolted in or held in by screws inserted through flanged wall portions such as portions 24 of FIG. 2.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An impeller shoe mounted on a turntable in a centrifugal inpact rock crushing machine, said turntable having an axis of rotation, said impeller shoe having a wear surface for receiving a stream of particulate matter flowing in a direction outwardly from said turntable and away from said axis of rotation, said wear surface having more than two substantially rounded ridges aligned parallel to one another and extending in the direction of the flow of said stream of particulate matter, each of said ridges having a gently sloping tip at an end thereof closest to said axis of rotation.

2. The impeller shoe of claim 1 wherein said ridges are formed in a crown in the wear surface of said shoe, said crown having a peak substantially along the centroid of said wear surface.

3. The impeller shoe of claim 1 wherein each of said ridges are set back from the end of the wear surface closest to said axis of rotation.

* * * * *